US009016439B2

(12) United States Patent
Ogawa

(10) Patent No.: US 9,016,439 B2
(45) Date of Patent: Apr. 28, 2015

(54) ELEVATOR HOISTING MACHINE BRAKING APPARATUS

(75) Inventor: Koji Ogawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 297 days.

(21) Appl. No.: 13/513,996

(22) PCT Filed: Feb. 10, 2010

(86) PCT No.: PCT/JP2010/051965

§ 371 (c)(1),
(2), (4) Date: Jun. 5, 2012

(87) PCT Pub. No.: WO2011/099123

PCT Pub. Date: Aug. 18, 2011

(65) Prior Publication Data

US 2012/0234632 A1 Sep. 20, 2012

(51) Int. Cl.

| | |
|---|---|
| ***B66B 11/08*** | (2006.01) |
| ***B66D 5/08*** | (2006.01) |
| ***B66D 5/30*** | (2006.01) |

(52) U.S. Cl.

CPC ... *B66D 5/08* (2013.01); *B66D 5/30* (2013.01)

(58) Field of Classification Search

CPC ..... B66B 5/02; B66B 11/08; B66D 5/08; B66D 5/30

USPC ..... 187/254

See application file for complete search history.

(56) References Cited

FOREIGN PATENT DOCUMENTS

| | | | | |
|---|---|---|---|---|
| CN | 1450974 | A | 10/2003 | |
| CN | 101492146 | A * | 7/2009 | |
| CN | 101857178 | A * | 10/2010 | |
| EP | 1 431 232 | A1 | 6/2004 | |
| EP | 1431232 | A1 * | 6/2004 | ..... B66B 11/08 |
| EP | 2206674 | A1 * | 7/2010 | |
| EP | 2452911 | A1 * | 5/2012 | |
| JP | 55-43143 | | 9/1953 | |
| JP | 3 17335 | | 2/1991 | |
| JP | 2673315 | | 11/1997 | |
| JP | 2009 46235 | | 3/2009 | |

(Continued)

OTHER PUBLICATIONS

English Machine Translation of CN 101492146 A.*

(Continued)

*Primary Examiner* — William E Dondero
*Assistant Examiner* — Diem Tran
(74) *Attorney, Agent, or Firm* — Oblon, McClelland, Maier & Neustadt, L.L.P.

(57) ABSTRACT

A braking apparatus main body has: a movable body; and an electromagnetic actuator that displaces the movable body in a direction of contact with and separation from a rotating body that is rotated relative to a hoisting machine main body. An adjusting collar is screwed into an adjusting threaded aperture disposed on the electromagnetic actuator. The adjusting collar is disposed between the hoisting machine main body and the electromagnetic actuator. The electromagnetic actuator is mounted to the hoisting machine main body by a mounting device in a state in which the hoisting machine main body bears the adjusting collar. A position of the braking apparatus main body relative to the hoisting machine main body is adjusted in a direction in which a distance between the electromagnetic actuator and the rotating body changes by adjusting an amount of thread engagement of the adjusting collar in the adjusting threaded aperture.

5 Claims, 5 Drawing Sheets

(56) References Cited

FOREIGN PATENT DOCUMENTS

| | | | | | |
|---|---|---|---|---|---|
| SU | 1184985 | A | | 10/1985 | |
| WO | WO 2009147708 | A1 | * | 12/2009 | ..... B66D 5/08 |
| WO | WO 2011153917 | A1 | * | 12/2011 | |

OTHER PUBLICATIONS

English Machine Translation of JP 2009-046235 A.*

International Search Report Issued Apr. 27, 2010 in PCT/JP10/51965 Filed Feb. 10, 2010.

Combined Chinese Office Action and Search Report issued Feb. 8, 2014, in Chinese Patent Application No. 201080063479.3 with English translation.

* cited by examiner

ELEVATOR HOISTING MACHINE BRAKING APPARATUS

TECHNICAL FIELD

The present invention relates to an elevator hoisting machine braking apparatus that is disposed on a hoisting machine that has a driving sheave around which is wound a rope or belt that suspends a car, and that brakes rotation of the driving sheave.

BACKGROUND ART

Conventionally, elevator hoisting machine braking apparatuses are known in which rotation of a brake drum is braked by a brake shoe pushing against the brake drum. A fixed core in which an electromagnetic coil is disposed is disposed at a predetermined position that is separated from the brake drum. A movable core that is displaced together with the brake shoe is disposed between the fixed core and the brake shoe. When passage of an electric current to the electromagnetic coil is started, the movable core is attracted to the fixed core, separating the brake shoe from the brake drum. When passage of the electric current to the electromagnetic coil is stopped, the movable core is displaced away from the fixed core by pressure from a compressed spring, pressing the brake shoe against the brake drum.

The movable core and the brake shoe are coupled by a plurality of spherical bolts that are disposed on the brake shoe each being screwed into the movable core. Adjustment of a gap between the brake drum and the brake shoe is performed by adjusting the amount of thread engagement of each of the spherical bolts in the movable core (See Patent Literature 1).

CITATION LIST

Patent Literature

[Patent Literature 1]
Japanese Patent Laid-Open No. 2009-46235 (Gazette)

SUMMARY OF THE INVENTION

Problem to be Solved by the Invention

However, because the plurality of spherical bolts are disposed between the movable core and the brake shoe, movable portions of the braking apparatus are enlarged. The entire braking apparatus is thereby enlarged.

In order to achieve size reductions in the movable portions of the braking apparatus, sandwiching liners between the brake shoe and the movable core, and adjusting the gap between the brake drum and the brake shoe by adjusting the number of liners is also conceivable, but in that kind of construction, the gap between the brake drum and the brake shoe cannot be adjusted continuously.

The present invention aims to solve the above problems and an object of the present invention is to provide an elevator hoisting machine braking apparatus that can achieve reductions in size, and in which a gap between a rotating body and a movable body can be adjusted continuously.

Means for Solving the Problem

In order to achieve the above object, according to one aspect of the present invention, there is provided an elevator hoisting machine braking apparatus including: a rotating body that is rotated relative to a hoisting machine main body; a braking apparatus main body that includes: a movable body; and an electromagnetic actuator that is mounted onto the hoisting machine main body, on which an adjusting threaded aperture is disposed, and that displaces the movable body in a direction of contact with and separation from the rotating body; an adjusting collar that is screwed into the adjusting threaded aperture, and that is disposed between the hoisting machine main body and the electromagnetic actuator; and a mounting device that mounts the electromagnetic actuator to the hoisting machine main body in a state in which the hoisting machine main body bears the adjusting collar, the elevator hoisting machine braking apparatus being characterized in that a position of the braking apparatus main body relative to the hoisting machine main body is adjusted in a direction in which a distance between the electromagnetic actuator and the rotating body changes by adjusting an amount of thread engagement of the adjusting collar in the adjusting threaded aperture.

Effects of the Invention

In an elevator hoisting machine braking apparatus according to the present invention, because the adjusting collar is screwed into the adjusting threaded aperture that is disposed on the electromagnetic actuator, and the electromagnetic actuator is mounted onto the hoisting machine main body in a state in which the hoisting machine main body bears the adjusting collar, adjustment of the gap between the rotating body and the movable body can be performed steplessly by adjusting the amount of thread engagement of the adjusting collar in the adjusting threaded aperture. Because it is no longer necessary to dispose a mechanism for adjusting the gap between the rotating body and the movable body on the movable body, size reductions in the movable body can be achieved. Overall reductions in the size of the braking apparatus can thereby be achieved.

In an elevator hoisting machine braking apparatus according to the present invention, because the distance between the adjusting member and the inner surface of the slot is changed in the major axis direction of the slot by adjusting the amount of protrusion of the adjusting member into the slot, and displacement of the electromagnetic actuator away from the rotating body is restricted by the adjusting member contacting the mounting member that is passed through the slot, adjustment of the gap between the rotating body and the movable body can be performed steplessly by adjusting the amount of protrusion of the adjusting member into the slot. Because it is no longer necessary to dispose a mechanism for adjusting the gap between the rotating body and the movable body on the movable body, size reductions in the movable body can be achieved. Overall reductions in the size of the braking apparatus can thereby be achieved.

DESCRIPTION OF EMBODIMENTS

Preferred embodiments of the present invention will now be explained with reference to the drawings.

Embodiment 1

Figure 1:
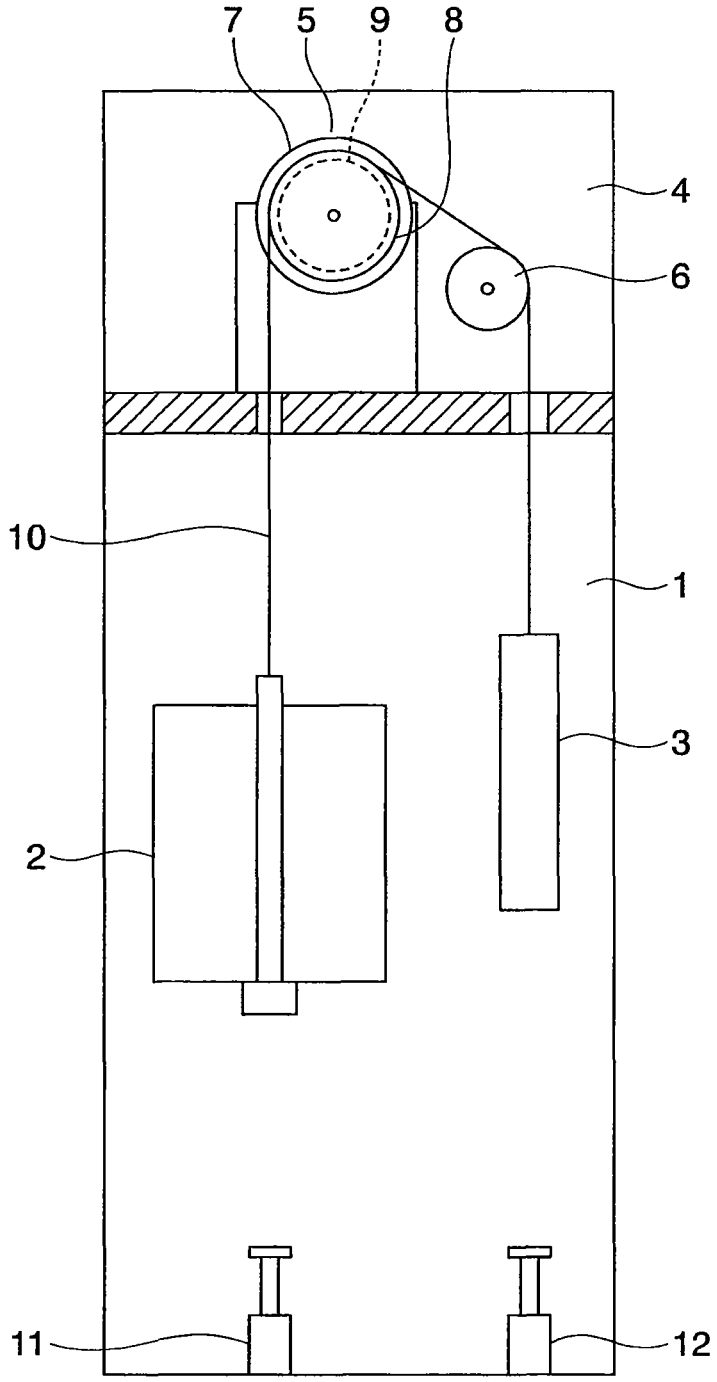
FIG. 1 is a configuration diagram that shows an elevator apparatus according to Embodiment 1 of the present invention.

FIG. 1 is a configuration diagram that shows an elevator apparatus according to Embodiment 1 of the present invention. In the figure, a car 2 and a counterweight 3 are disposed so as to be able to be raised and lowered inside a hoistway 1. A machine room 4 is disposed in an upper portion of the hoistway 1. A hoisting machine 5 that generates a driving force that raises and lowers the car 2 and the counterweight 3 inside the hoistway 1 and a deflecting sheave 6 are disposed in the machine room 4.

The hoisting machine 5 has: a hoisting machine main body 7 that includes a motor; a driving sheave 8 that is rotated by the hoisting machine main body 7; and a braking apparatus (an elevator hoisting machine braking apparatus) 9 that brakes the rotation of the driving sheave 8. The deflecting sheave 6 is disposed so as to be separated from the driving sheave 8.

The car 2 and the counterweight 3 are suspended inside the hoistway 1 by a plurality of suspending bodies 10 that are wound around the driving sheave 8 and the deflecting sheave 6. Ropes or belts, for example, are used as the suspending bodies 10. The car 2 and the counterweight 3 are raised and lowered inside the hoistway 1 by rotation of the driving sheave 8.

Moreover, a car buffer 11 that is positioned below the car 2, and a counterweight buffer 12 that is positioned below the counterweight 3 are disposed in a bottom portion (a pit) of the hoistway 1. If subjected to a collision with the car 2, the car buffer 11 relieves mechanical shock that is imparted to the car 2. If subjected to a collision with the counterweight 3, the counterweight buffer 12 relieves mechanical shock that is imparted to the counterweight 3.

Figure 2:
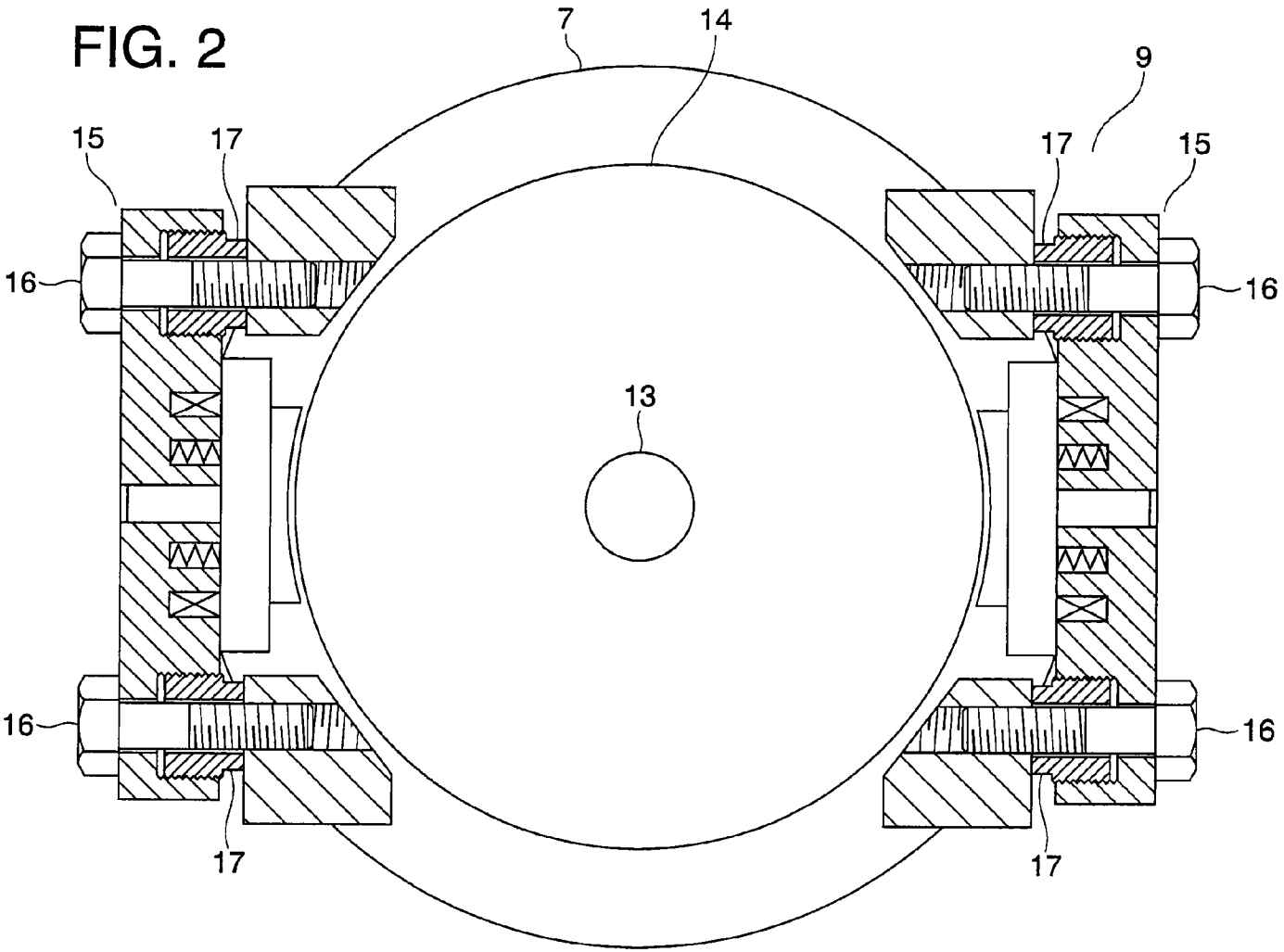
FIG. 2 is a front elevation that shows a braking apparatus from FIG. 1.

FIG. 2 is a front elevation that shows the braking apparatus 9 from FIG. 1. In the figure, the braking apparatus 9 brakes the driving sheave 8 by applying a braking force to a rotating shaft 13 of the motor (a main shaft of the hoisting machine 5) in the hoisting machine main body 7. The braking apparatus 9 includes: a brake drum (a rotating body) 14 that is rotated together with the rotating shaft 13; a pair of braking apparatus main bodies 15 that apply a braking force to the brake drum 14; a plurality of mounting bolts (mounting devices) 16 that respectively mount each of the braking apparatus main bodies 15 to the hoisting machine main body 7; and a plurality of adjusting collars 17 that separately adjust positions of each of the braking apparatus main bodies 15 relative to the hoisting machine main body 7.

Each of the braking apparatus main bodies 15 is disposed at a position radially outside the brake drum 14. The braking apparatus main bodies 15 are disposed at symmetrical positions relative to the shaft axis of the rotating shaft 13.

In this example, the braking apparatus main bodies 15 are mounted to the hoisting machine main body 7 by two mounting bolts 16 in each braking apparatus main body 15. Furthermore, in this example, the position of each of the braking apparatus main bodies 15 relative to the hoisting machine main body 7 is adjusted by two adjusting collars 17 in each braking apparatus main body 15.

Figure 3:
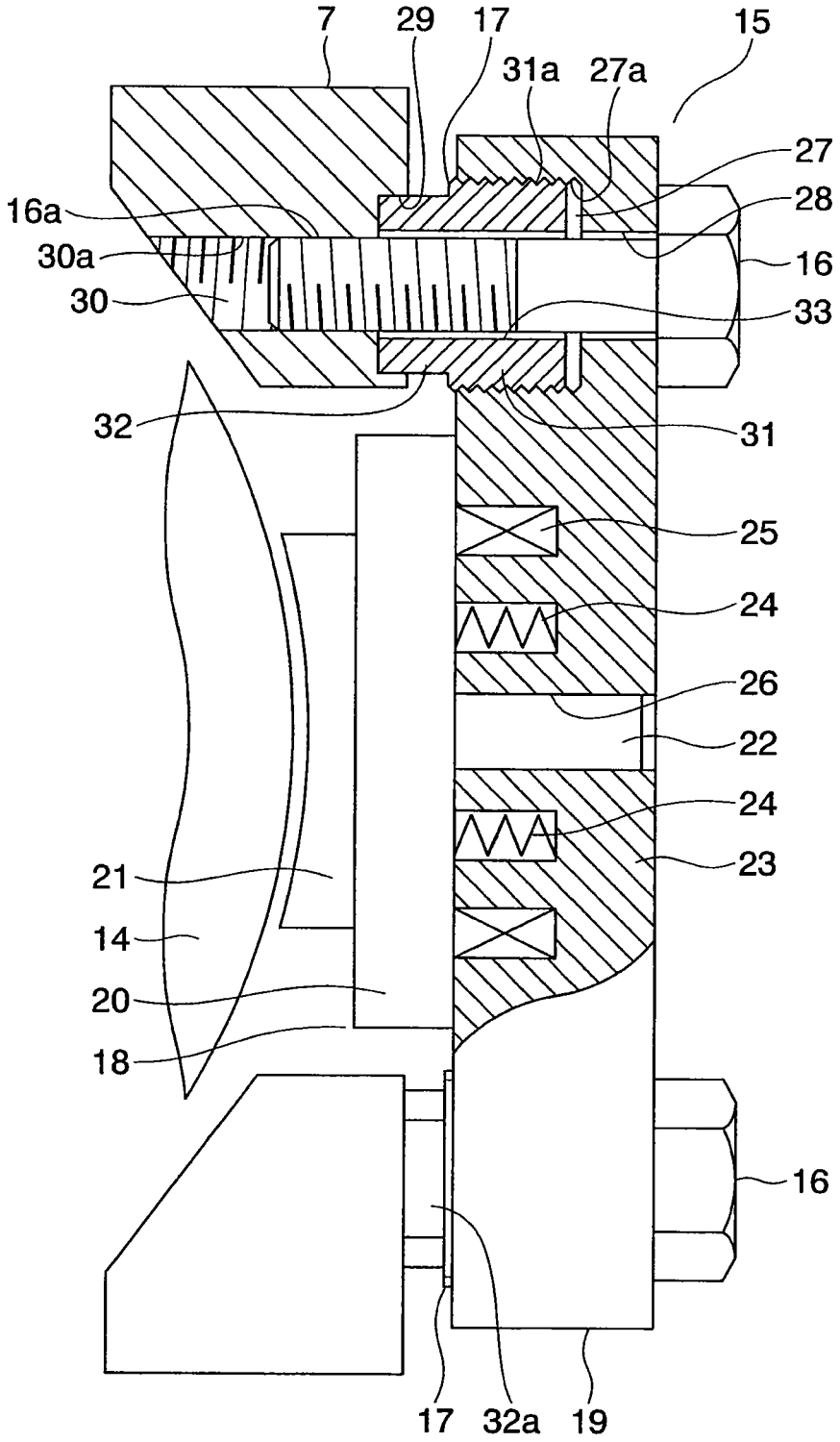
FIG. 3 is an enlargement that shows a braking apparatus main body from FIG. 2.

FIG. 3 is an enlargement that shows a braking apparatus main body 15 from FIG. 2. In the figure, the braking apparatus main body 15 has: a movable body 18; and an electromagnetic actuator 19 that displaces the movable body 18 in a direction of contact with and separation from an outer circumferential portion of the brake drum 14.

The movable body 18 has: a movable core 20; a friction pad 21 that is disposed on the movable core 20; and a guiding pin 22 that protrudes outward from the movable core 20 in a direction in which the movable body 18 is displaced. The movable body 18 is displaceable in a direction in which the friction pad 21 separates from and contacts with the outer circumferential portion of the brake drum 14.

The movable core 20 and the friction pad 21 are disposed between the outer circumferential portion of the brake drum 14 and the electromagnetic actuator 19. The friction pad 21 is disposed on a surface of the movable core 20 near the brake drum 14. The guiding pin 22 protrudes from the movable core 20 on a side near the electromagnetic actuator 19.

The electromagnetic actuator 19 has: a fixed core 23 that is disposed so as to be separated from the brake drum 14; a plurality of forcing springs (forcing bodies) 24 that are disposed on the fixed core 23, and that force the movable body 18 in a direction of contact with the outer circumferential portion of the brake drum 14; and an electromagnetic coil 25 that is disposed on the fixed core 23, and that displaces the movable body 18 in a direction of separation from the outer circumferential portion of the brake drum 14 in opposition to the forces from the forcing springs 24.

A guiding aperture 26 that passes through the fixed core 23 in the direction in which the movable body 18 is displaced is disposed in a central portion of the fixed core 23. The guiding pin 22 is inserted into the guiding aperture 26. The guiding pin 22 is guided by the guiding aperture 26 while the movable body 18 is displaced in the direction of separation from and contact with the outer circumferential portion of the brake drum 14.

Each of the forcing springs 24 and the electromagnetic coil 25 are disposed around the guiding aperture 26. Each of the forcing springs 24 is compressed between the fixed core 23 and the movable core 20. The elastic force of recovery from the forcing springs 24 is the force that pushes the movable body 18. The electromagnetic coil 25 generates an electromagnetic attractive force that attracts the movable core 20 toward the fixed core 23 on passage of an electric current. The movable body 18 is displaced away from the outer circumferential portion of the brake drum 14 by the movable core 20 being subjected to the electromagnetic attractive force from the electromagnetic coil 25 and being displaced toward the fixed core 23.

The braking force is applied to the brake drum 14 by the movable body 18 contacting the outer circumferential portion of the brake drum 14. The braking force that is applied to the brake drum 14 is released by the movable body 18 moving away from the brake drum 14.

A pair of adjusting threaded apertures 27 are disposed on an outer circumferential portion of the fixed core 23. A depth direction of the adjusting threaded apertures 27 is oriented in the direction that the movable body 18 is displaced (a depth direction of the guiding aperture 26). Opening portions of the adjusting threaded apertures 27 face the hoisting machine main body 7. In this example, the adjusting threaded apertures 27 are disposed at symmetrical positions relative to the shaft axis of the guiding aperture 26.

A pair of mounting penetrating apertures 28 that pass through the fixed core 23 are disposed on outer circumferential portions of the fixed core 23. A depth direction of the mounting penetrating apertures 28 is oriented in the depth direction of the adjusting threaded apertures 27. In this example, an inside diameter of the mounting penetrating apertures 28 is smaller than an inside diameter of the adjusting threaded apertures 27. The mounting penetrating apertures 28 are disposed at positions that join the outer surface of the fixed core 23 and bottom surfaces of the adjusting threaded aperture 27. In addition, the adjusting threaded apertures 27 and the mounting penetrating apertures 28 are disposed coaxially.

Disposed on the hoisting machine main body 7 are: a plurality of interfitting recess portions (interfitting portions) 29 into which the adjusting collars 17 fit; and a plurality of mounting threaded apertures 30 into which the mounting bolts 16 are screwed.

The interfitting recess portions 29 face the opening portions of the adjusting threaded apertures 27. A cross-sectional shape of the interfitting recess portions 29 is circular. The interfitting recess portions 29 are reamer bores that are formed precisely by a reamer. An inside diameter of the mounting threaded aperture 30 is smaller than an inside diameter of the interfitting recess portions 29. A depth direction of the interfitting recess portions 29 and the mounting threaded apertures 30 is oriented in a direction in which the movable body 18 is displaced. In this example, the interfitting recess portions 29 and the mounting threaded apertures 30 are disposed coaxially. Consequently, opening portions of the mounting threaded apertures 30 are formed on bottom surfaces of the interfitting recess portions 29.

The adjusting collars 17 are disposed between the hoisting machine main body 7 and the electromagnetic actuator 19. The adjusting collars 17 are columnar members that have a shaft axis. In addition, the adjusting collars 17 have: threaded engaging portions 31 on outer circumferential portions of which screw threaded portions 31*a* are disposed; and interfitting cylinder portions 32 that protrude outward from the threaded engaging portions 31 parallel to the shaft axes of the adjusting collars 17.

The screw threaded portions 31*a* of the threaded engaging portions 31*b* are screwed together with the screw threaded portions 27*a* of the adjusting threaded apertures 27. The adjusting collars 17 are disposed so as to be coaxial to the adjusting threaded apertures 27 by the screw threaded portions 31*a* being screwed together with the screw threaded portions 27*a*.

Cross-sectional shapes of end portions of the interlining cylinder portions 32 are set so as to match with cross-sectional shapes of the interlining recess portions 29. The end portions of the interfitting cylinder portions 32 are thereby configured so as to fit into the interfitting recess portions 29 without leaving gaps. In other words, the interfitting cylinder portions 32 and the interfitting recess portions 29 are configured so as to be fitted together by reaming. The adjusting collars 17 are disposed so as to be coaxial to the interfitting recess portions 29 by the interfitting cylinder portions 32 fitting into the interfitting recess portions 29. Engaging surfaces 32*a* with which a tool for turning the adjusting collars 17 is engaged are formed on portions of the outer circumferential portions of the interfitting cylinder portions 32. An amount of thread engagement of the adjusting collars 17 in the adjusting threaded apertures 27 is adjusted by the adjusting collars 17 being turned.

An amount of protrusion of the adjusting collars 17 from the fixed core 23 is adjustable by adjusting the amount of thread engagement of the adjusting collars 17 in the adjusting threaded apertures 27. Consequently, a position of the braking apparatus main body 15 relative to the brake drum 14 can be adjusted in a direction in which a distance between the electromagnetic actuator 19 and the brake drum 14 changes (that is, the direction in which the movable body 18 is displaced) by adjusting the amount of thread engagement of the adjusting collars 17 in the adjusting threaded apertures 27. Adjustment of a gap between the brake drum 14 and the friction pad 21 can be performed by adjusting the position of the braking apparatus main body 15 relative to the brake drum 14.

Bolt passage apertures 33 pass through central portions of the adjusting collars 17 parallel to the shaft axes of the adjusting collars 17. The bolt passage apertures 33 are disposed so as to be coaxial to the mounting penetrating apertures 28 by the adjusting collars 17 being screwed into the adjusting threaded apertures 27. The bolt passage apertures 33 are disposed so as to be coaxial to the mounting threaded apertures 30 by the adjusting collars 17 fitting into the interfitting recess portions 29.

Screw threaded portions 16*a* that are screwed into the screw threaded portions 30*a* of the mounting threaded apertures 30 are disposed on end portions of the mounting bolts 16. The mounting bolts 16 are screwed into the mounting threaded apertures 30 by screwing the screw threaded portions 16*a* and the screw threaded portions 30*a* together. The mounting bolts 16 are passed sequentially through the mounting penetrating apertures 28 and the bolt passage apertures 33 to be screwed into the mounting threaded apertures 30. The electromagnetic actuator 19 is mounted to the hoisting machine main body 7 by the mounting bolts 16 being screwed into the mounting threaded apertures 30 in a state in which the adjusting collars 17 are fitted into the interfitting recess portions 29. Specifically, the mounting bolts 16 mount the electromagnetic actuator 19 to the hoisting machine main body 7 in a state in which the hoisting machine main body 7 bears the adjusting collars 17. The position of the electromagnetic actuator 19 relative to the hoisting machine main body 7 is fixed by the mounting bolts 16 that are screwed into the mounting threaded apertures 30 being tightened. The adjusting collars 17 are pressed onto the hoisting machine main body 7 by tightening the mounting bolts 16 in a state in which the electromagnetic actuator 19 is mounted to the hoisting machine main body 7.

Next, operation will be explained. When passage of the electric current to the electromagnetic coil 25 is stopped, the friction pad 21 of the movable body 18 contacts the outer circumferential portion of the brake drum 14 due to the force from the forcing springs 24. A braking force is thereby applied to the brake drum 14, applying a braking force to the driving sheave 8.

When passage of the electric current to the electromagnetic coil 25 is started, the electromagnetic coil 25 generates an electromagnetic attractive force that attracts the movable core 20. The movable body 18 is thereby displaced away from the brake drum 14 in opposition to the force from the forcing springs 24. The braking force that is applied to the brake drum 14 and the driving sheave 8 is thereby released.

Next, a procedure when adjusting the gap between the brake drum 14 and the friction pad 21 will be explained. First, the mounting bolts 16 are loosened. After that, a tool (a spanner, for example) is engaged with an engaging surface 32*a* of the adjusting collars 17, and the amount of thread engagement of the adjusting collars 17 relative to the adjusting threaded apertures 27 are adjusted while turning the adjusting collars 17 using the tool. The position of the braking apparatus main body 15 relative to the brake drum 14 is adjusted thereby, adjusting the gap between the friction pad 21 and the brake drum 14.

The adjustment of the gap between the brake drum 14 and the friction pad 21 is completed, and then the mounting bolts 16 are fastened. The position of the fixed core 23 is thereby fixed relative to the hoisting machine main body 7, completing the adjusting operation of the gap between the brake drum 14 and the friction pad 21.

In an elevator hoisting machine braking apparatus 9 of this kind, because the adjusting collars 17 are screwed into the adjusting threaded apertures 27 that are disposed on the electromagnetic actuator 19, and the electromagnetic actuator 19 is mounted onto the hoisting machine main body 7 in a state in which the hoisting machine main body 7 bears the adjusting collars 17, adjustment of the gap between the brake drum 14 and the movable body 18 can be performed steplessly (in other words, continuously) by adjusting the amount of thread engagement of the adjusting collars 17 in the adjusting threaded apertures 27. The gap between the brake drum 14 and the movable body 18 can thereby be adjusted more accurately, enabling harmful effects, such as the required capacity of the electromagnetic coil 25 being increased, or brake operating noise increasing, for example, to be suppressed. Because it is no longer necessary to dispose a mechanism for adjusting the gap between the brake drum 14 and the movable body 18 on the movable body 18, size reductions in the movable body 18 can be achieved. Overall reductions in the size of the braking apparatus 9 can thereby be achieved.

Because the bolt passage apertures 33 are disposed on the adjusting collars 17, and the electromagnetic actuator 19 is mounted onto the hoisting machine main body 7 by screwing the mounting bolts 16 that are passed through the bolt passage apertures 33 into the mounting threaded apertures 30 of the hoisting machine main body, portions of the mounting bolts 16 can be disposed inside the adjusting collars 17, enabling the installation space for the adjusting collars 17 and the mounting bolts 16 to be reduced. Further size reductions in the braking apparatus 9 are thereby enabled. The fastening force between the mounting bolts 16 and the hoisting machine main body 7 can also be applied axially to the adjusting collars 17, enabling reliability of the mounted state of the electromagnetic actuator 19 by the mounting bolts 16 to be improved.

Because the interfitting recess portions 29 into which the adjusting collars 17 fit are disposed on the hoisting machine main body 7, positioning of the adjusting collars 17 relative to the hoisting machine main body 7 can be performed easily, and the braking apparatus main body 15 can be mounted easily to a predetermined position on the hoisting machine main body 7. When the adjusting collars 17 bear the reaction force to the braking force that brakes the rotation of the brake drum 14, the adjusting collars 17 can be held on the hoisting machine main body 7 by shearing forces from the adjusting collars 17. Consequently, the adjusting collars 17 can be held on the hoisting machine main body 7 more reliably than if the hoisting machine main body 7 simply comes into surface contact with the adjusting collars 17 (that is, than if the adjusting collars 17 are held on the hoisting machine main body 7 by friction). Thus, the burden of the mounting bolts 16 against the reaction force to the braking force from the brake drum 14 can be reduced, enabling the size of the mounting bolts 16 to be reduced.

Embodiment 2

Figure 4:
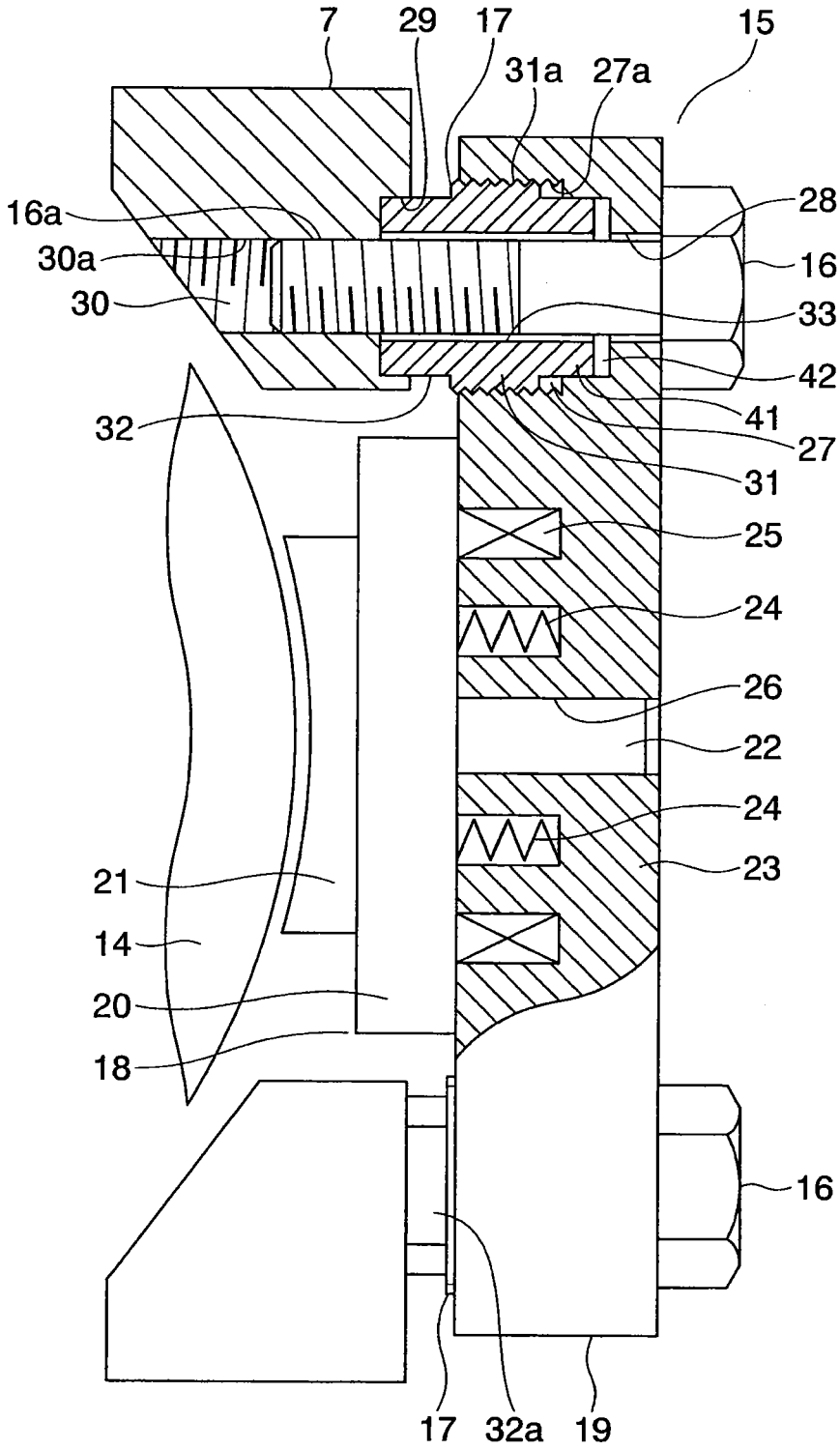
FIG. 4 is a partial cross section that shows an elevator hoisting machine braking apparatus according to Embodiment 2 of the present invention.

FIG. 4 is a partial cross section that shows an elevator hoisting machine braking apparatus according to Embodiment 2 of the present invention. In the figure, adjusting collars 17 have: threaded engaging portions 31 that are screwed into adjusting threaded apertures 27; and interfitting cylinder portions 32 and guiding cylinder portions 41 that protrude outward from the threaded engaging portions 31 in mutually opposite directions that are parallel to shaft axes of the adjusting collars 17. The rest of the configuration of the threaded engaging portions 31 and the interfitting cylinder portions 32 is similar or identical to that of Embodiment 1.

Guiding interfitting apertures (guiding portions) 42 that have circular cross sections into which the guiding cylinder portions 41 fit without leaving gaps are disposed on a fixed core 23. The guiding interfitting apertures 42 are reamer bores that are formed by a method that is similar or identical to that of the interfitting recess portions 29. Consequently, the guiding cylinder portions 41 and the guiding interfitting apertures 42 are configured so as to be fitted together by reaming. The guiding interfitting apertures 42 are disposed so as to be coaxial to the adjusting threaded apertures 27. In this example, the guiding interfitting apertures 42 are recess portions that are disposed on bottom surfaces of the adjusting threaded apertures 27. In this example, an inside diameter of the guiding interfitting apertures 42 is smaller than an inside diameter of the adjusting threaded apertures 27, and an inside diameter of the mounting penetrating apertures 28 is smaller than the inside diameter of the guiding interfitting apertures 42. The mounting penetrating apertures 28 are disposed at positions that join the bottom surfaces of the guiding interfitting apertures 42 and the outer surface of the fixed core 23.

When the amount of thread engagement of the adjusting collars 17 relative to the adjusting threaded apertures 27 is adjusted, the guiding cylinder portions 41 are guided by the guiding interfitting apertures 42 while the adjusting collars 17 are displaced relative to the fixed core 23. In other words, the guiding interfitting apertures 42 guide the adjusting collars 17, which are displaced relative to the fixed core 23 together with the adjustment of the amount of thread engagement of the adjusting collars 17 in the adjusting threaded apertures 27.

The rest of the configuration is similar or identical to that of Embodiment 1.

In an elevator hoisting machine braking apparatus 9 of this kind, because the guiding interfitting apertures 42 that guide the adjusting collars 17 are disposed on the fixed core 23, wobbling of the adjusting collars 17 relative to the fixed core 23 that results from gaps at the engaged portions between the adjusting collars 17 and the adjusting threaded apertures 27 can be suppressed by the guiding interfitting apertures 42. Consequently, precision of positioning of the electromagnetic actuator 19 relative to the brake drum 14 can be further improved.

Embodiment 3

Figure 5:
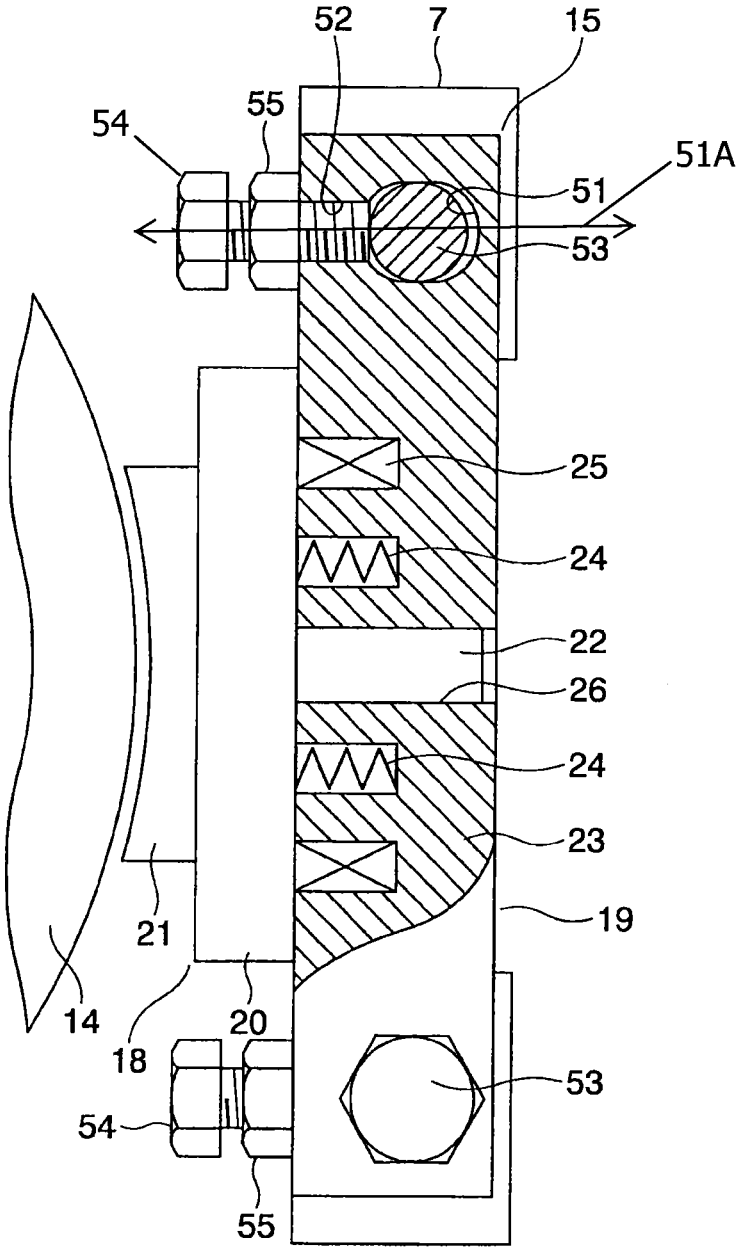
FIG. 5 is a partial cross section that shows an elevator hoisting machine braking apparatus according to Embodiment 3 of the present invention.

FIG. 5 is a partial cross section that shows an elevator hoisting machine braking apparatus according to Embodiment 3 of the present invention. In the figure, disposed on two end portions of a fixed core 23 are: a pair of slots (mounting penetrating apertures) 51 that pass through the fixed core 23 in a direction that intersects a direction in which a movable body 18 is displaced (a depth direction of a guiding aperture 26); and a pair of adjusting threaded apertures 52 that respectively communicate between an internal portion of each of the slots 51 and an external portion of the fixed core 23. In this example, each of the slots 51 pass through the fixed core 23 in a direction that is parallel to a shaft axis of a rotating shaft 13. It is an axiom of geometry that two lines or directions that intersect are not parallel to each other.

Each of the slots 51 is disposed on the fixed core 23 such that a major axial direction 5A thereof is oriented in the direction in which the movable body 18 is displaced (in other words, the depth direction of the guiding aperture 26). The major axial direction 51A is also referred to as a sliding axis direction. A length of the slot is perpendicular to the plane of the drawing sheet of FIG. 5. Further, as shown in FIG. 5, the length of the slot is perpendicular to the sliding axis direction.

A depth direction of the adjusting threaded apertures 52 is oriented in the direction in which the movable body 18 is displaced (in other words, the depth direction of the guiding aperture 26). The positions of the adjusting threaded apertures 52 are positions that are closer to the brake drum 14 when viewed from the slots 51.

Rod-shaped reamer bolts (mounting members) 53 that function as mounting devices that mount a braking apparatus main body 15 onto a hoisting machine main body 7 are passed through the slots 51. A minor axis of the slots 51 is set to match an outside diameter of the reamer bolts 53. The reamer bolts 53 are thereby configured so as to fit into the slots 51 without leaving gaps in a minor axis direction of the slots 51. The position of the fixed core 23 relative to the reamer bolts 53 is adjustable within a range of the dimension of the slots 51 in the major axis direction of the slots 51.

Mounting threaded apertures (not shown) into which the reamer bolts 53 are screwed are disposed on the hoisting machine main body 7. A depth direction of the mounting threaded apertures is oriented in a direction that is parallel to the shaft axis of the rotating shaft 13. Consequently, the reamer bolts 53 are mounted onto the hoisting machine main body 7 so as to be parallel to the shaft axis of the rotating shaft 13 by being screwed into the mounting threaded apertures. An electromagnetic actuator 19 is mounted onto the hoisting machine main body 7 by the reamer bolts 53 that are passed through the slots 51 being mounted to the hoisting machine main body 7. A position of the electromagnetic actuator 19 relative to the hoisting machine main body 7 is fixed by the reamer bolts 53 being fastened.

Stopper bolts (adjusting members) 54 are screwed into the adjusting threaded apertures 52. The stopper bolts 54 are displaced in the depth direction of the adjusting threaded apertures 52 relative to the fixed core 23 by being turned when screwed into adjusting threaded apertures 52, and can be made to protrude inside the slots 51. The amount of protrusion of the stopper bolts 54 into the slots 51 is adjusted by adjusting the amount of thread engagement of the stopper bolts 54 in the adjusting threaded apertures 52. Distances between inner surfaces of the slots 51 and the stopper bolts 54 in the major axis direction of the slots 51 are changed by adjusting the amount of protrusion of the stopper bolts 54 into the slots 51.

The position of the electromagnetic actuator 19 relative to the hoisting machine main body 7 is adjustable within a range of the dimension of the slots 51 in the major axis direction of the slots 51 when the stopper bolts 54 do not protrude inside the slots 51. When the stopper bolts 54 protrude into the slots 51, on the other hand, displacement of the electromagnetic actuator 19 away from the brake drum 14 is restricted by the stopper bolts 54 contacting the reamer bolts 53. Consequently, when the stopper bolts 54 protrude into the slots 51, the position of the electromagnetic actuator 19 relative to the hoisting machine main body 7 is adjustable in the major axis direction of the slots 51 between the inner surfaces of the slots 51 and the stopper bolts 54.

Locknuts 55 for fixing the positions of the stopper bolts 54 relative to the fixed core 23 are screwed onto the stopper bolts 54. The positions of the stopper bolts 54 relative to the fixed core 23 are fixed by fastening the locknuts 55 so as to be in contact with an outer surface of the fixed core 23. Moreover, an adjusting apparatus that adjusts the position of the braking apparatus main body 15 relative to the hoisting machine main body 7 includes the stopper bolts 54 and the locknuts 55. The rest of the configuration is similar or identical to that of Embodiment 1.

Next, a procedure when adjusting the gap between the brake drum 14 and the friction pad 21 will be explained. First, the locknuts 55 are loosened and the reamer bolts 53 are loosened. Next, the stopper bolts 54 are turned in a direction in which the amount of protrusion into the slots 51 is reduced. The position of the electromagnetic actuator 19 relative to the hoisting machine main body 7 is then adjusted by displacing the electromagnetic actuator 19 on the reamer bolts 53 parallel to the slots 51. The position of the braking apparatus main body 15 relative to the brake drum 14 is adjusted thereby, adjusting the gap between the friction pad 21 and the brake drum 14.

The adjustment of the gap between the brake drum 14 and the friction pad 21 is completed, and then the reamer bolts 53 are tightened. The position of the electromagnetic actuator 19 relative to the hoisting machine main body 7 is thereby fixed. Next, the stopper bolts 54 are turned in the direction in which the amount of protrusion into the slots 51 increases to place the stopper bolts 54 in contact with the reamer bolts 53. The loosened locknuts 55 are then tightened. The amount of protrusion of the stopper bolts 54 into the slots 51 is thereby fixed, completing the adjusting operation of the gap between the brake drum 14 and the friction pad 21.

In an elevator hoisting machine braking apparatus 9 of this kind, because the distances between the stopper bolts 54 and the inner surfaces of the slots 51 are changed in the major axis direction of the slots 51 by adjusting the amount of protrusion of the stopper bolts 54 into the slots 51, and displacement of the electromagnetic actuator 19 away from the brake drum 14 is restricted by the stopper bolts 54 contacting the reamer bolts 53 that are passed through the slots 51, adjustment of the gap between the brake drum 14 and the movable body 18 can be performed steplessly by adjusting the amount of protrusion of the stopper bolts 54 into the slots 51. Because it is no longer necessary to dispose a mechanism for adjusting the gap between the brake drum 14 and the movable body 18 on the movable body 18, size reductions in the movable body 18 can be achieved. Overall reductions in the size of the braking apparatus 9 can thereby be achieved. In addition, even if the electromagnetic actuator 19 is displaced further away from the brake drum 14 than a predetermined adjusted position due to loosening of or damage to the stopper bolts 54, displacement of the electromagnetic actuator 19 relative to the reamer bolts 53 can be kept within a range of a dimension of the slots 51. Consequently, even if the stopper bolts 54 are damaged, the movable body 18 can be made to contact the brake drum 14 to apply a braking force to the brake drum 14 when the passage of electric current to the electromagnetic coil 25 is stopped. Thus, operational reliability of the braking apparatus 9 can be improved.

Because the stopper bolts 54 contact the reamer bolts 53 from a side near the brake drum 14, the reaction force of the forcing springs 24 when the movable body 18 contacts the brake drum 14 can be applied to the stopper bolts 54 as a compressive force from the reamer bolts 53. Normally, compressive strength of a member that is constituted by a material such as a metal is known to be greater than tensile strength. Consequently, by applying the reaction force of the forcing springs 24 to the stopper bolts 54 as a compressive force, the stopper bolts 54 can be made less likely to be damaged, enabling mechanical reliability of the stopper bolts 54 to be improved. Thus, operational reliability of the braking apparatus 9 can be further improved.

Moreover, In the above example, the depth direction of the slots 51 is a direction that is parallel to the rotating shaft 13, but the slots 51 may also be passed through the fixed core 23 in a direction that is inclined relative to the rotating shaft 13.

In the above example, reamer bolts 53 are used as the mounting member that is passed through the slots 51, but the mounting member is not limited thereto. A rod-shaped pin that is mounted to the hoisting machine main body 7 may also be used, for example. The cross-sectional shape of the mounting member is not limited being circular, and may also be rectangular, or elliptical, for example.

In the above example, adjustment of the position of the electromagnetic actuator 19 relative to the hoisting machine main body 7 is performed without using the stopper bolts 54, but the position of the electromagnetic actuator 19 relative to the hoisting machine main body 7 may also be adjusted using the stopper bolts 54. In other words, the position of the electromagnetic actuator 19 relative to the hoisting machine main body 7 may also be adjusted by placing the stopper bolts 54 in contact with the reamer bolts 53 while adjusting the amount of thread engagement of the stopper bolts 54 relative to the adjusting threaded apertures 52.

In Embodiments 1 and 2 above, bolt passage apertures 33 through which the mounting bolts 16 are passed are disposed on the adjusting collars 17, but the bolt passage apertures 33 may also be omitted. In that case, the adjusting threaded apertures 27 and the mounting penetrating apertures 28 can be disposed independently on the fixed core 23 so as to be separated from each other. Consequently, the mounting bolts 16 are passed through the mounting penetrating apertures 28 at positions that are separated from the adjusting collars 17, and are screwed into the mounting threaded apertures 30 of the hoisting machine main body 7.

In Embodiments 1 and 2 above, interfitting recess portions 29 into which the adjusting collars 17 fit are disposed on the hoisting machine main body 7, but the interfitting recess portions 29 may also be omitted. In this manner, adjustment of the gap between the brake drum 14 and the movable body 18 can also be performed steplessly, and overall reductions in the size of the braking apparatus 9 can also be achieved.

In Embodiments 1 and 2 above, the interfitting recess portions 29 are disposed on the hoisting machine main body 7 as interfitting portions that fit over the adjusting collars 17, but recess portions may also be disposed on the adjusting collars 17, and projections into which the recess portions of the adjusting collars 17 fit may be disposed on the hoisting machine main body 7 as interfitting portions.

EXPLANATION OF NUMBERING

7 HOISTING MACHINE MAIN BODY, 14 BRAKE DRUM (ROTATING BODY), 15 BRAKING APPARATUS MAIN BODY, 16 MOUNTING BOLTS (MOUNTING DEVICES), 17 ADJUSTING COLLARS, 18 MOVABLE BODY, 19 ELECTROMAGNETIC ACTUATOR, 27 ADJUSTING THREADED APERTURES, 29 INTERFITTING RECESS PORTIONS (INTERFITTING PORTIONS), 30 MOUNTING THREADED APERTURES, 33 BOLT PASSAGE APERTURES, 42 GUIDING INTERFITTING APERTURES (GUIDING PORTIONS), 51 SLOTS, 52 ADJUSTING THREADED APERTURES, 53 REAMER BOLTS (MOUNTING MEMBERS), 54 STOPPER BOLTS (ADJUSTING MEMBERS).

The invention claimed is:

1. An elevator hoisting machine braking apparatus comprising:

a rotating body that is rotated relative to a hoisting machine main body;

a braking apparatus main body that comprises:

a movable body; and an electromagnetic actuator that is mounted onto the hoisting machine main body, on which an adjusting threaded aperture is disposed, and that displaces the movable body in a direction of contact with and separation from the rotating body;

an adjusting collar that is screwed into the adjusting threaded aperture, and that is disposed between the hoisting machine main body and the electromagnetic actuator; and a mounting device that mounts the electromagnetic actuator to the hoisting machine main body in a state in which the hoisting machine main body bears the adjusting collar, the elevator hoisting machine braking apparatus being characterized in that a position of the braking apparatus main body relative to the hoisting machine main body is adjusted in a direction in which a distance between the electromagnetic actuator and the rotating body changes by adjusting an amount of thread engagement of the adjusting collar in the adjusting threaded aperture.

2. An elevator hoisting machine braking apparatus according to claim 1, characterized in that:

the mounting device comprises a mounting bolt that is screwed into a mounting threaded aperture that is disposed on the hoisting machine main body;

a bolt passage aperture through which the mounting bolt is passed is disposed on the adjusting collar; and the electromagnetic actuator is mounted onto the hoisting machine main body by screwing into the mounting threaded aperture the mounting bolt that is passed through the bolt passage aperture.

3. An elevator hoisting machine braking apparatus according to claim 1, characterized in that an interfitting portion into which the adjusting collar fits is disposed on the hoisting machine main body.

4. An elevator hoisting machine braking apparatus according to claim 1, characterized in that a guiding portion that guides the adjusting collar and that is displaced relative to the electromagnetic actuator together with adjustment of the amount of thread engagement of the adjusting collar in the adjusting threaded aperture is disposed on the electromagnetic actuator.

5. An elevator hoisting machine braking apparatus comprising:

a rotating body that is rotated relative to a hoisting machine main body;

a braking apparatus main body that comprises:

a movable body including a slot; and an electromagnetic actuator that is mounted onto the hoisting machine main body, and that displaces the movable body in a direction of contact with and separation from the rotating body, wherein the slot has a length which is not parallel to a direction of displacement of the movable body, a sliding axis direction of the slot is oriented in a direction of displacement of the movable body and perpendicular to the length of the slot;

a mounting device including a rod-shaped mounting member, and that mounts the electromagnetic actuator to the hoisting machine main body by the mounting member being passed through the length of the slot and mounted to the hoisting machine main body; and an adjusting apparatus that has an adjusting member that is screwed into an adjusting threaded aperture that communicates between an internal portion of the slot and an external portion of the electromagnetic actuator, and that changes a distance between an inner surface of the slot and the adjusting member in the sliding axis direction of the slot by adjusting an amount of protrusion of the adjusting member into the slot, the elevator hoisting machine braking apparatus being characterized in that displacement of the electromagnetic actuator away from the rotating body is restricted by the adjusting member contacting the mounting member.

* * * * *